US010486031B2

(12) United States Patent
Mimura et al.

(10) Patent No.: US 10,486,031 B2
(45) **Date of Patent: *Nov. 26, 2019**

(54) GOLF BALL

(71) Applicant: SUMITOMO RUBBER INDUSTRIES, LTD., Kobe-shi, Hyogo (JP)

(72) Inventors: Kohei Mimura, Kobe (JP); Takahiro Sajima, Kobe (JP); Kosuke Tachibana, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/874,628

(22) Filed: Jan. 18, 2018

(65) Prior Publication Data

US 2018/0140904 A1 May 24, 2018

Related U.S. Application Data

(63) Continuation of application No. 15/132,909, filed on Apr. 19, 2016, now Pat. No. 9,914,021.

(30) Foreign Application Priority Data

Apr. 27, 2015 (JP) ..... 2015-090787

(51) Int. Cl.
*A63B 37/00* (2006.01)

(52) U.S. Cl.
CPC ..... *A63B 37/0092* (2013.01); *A63B 37/0031* (2013.01); *A63B 37/0033* (2013.01);
(Continued)

(58) Field of Classification Search
CPC ..... A63B 37/0063; A63B 37/0044; A63B 37/0038; A63B 37/0092; A63B 37/0043; A63B 37/0062; A63B 37/0076
See application file for complete search history.

(56) References Cited

U.S. PATENT DOCUMENTS 6,551,202 B1 * 4/2003 Yoshida ..... A63B 37/06 473/371
2008/0214324 A1 9/2008 Nanba et al.
(Continued)

FOREIGN PATENT DOCUMENTS

EP 3037137 A1 6/2016
JP 2008-212681 A 9/2008
(Continued)

OTHER PUBLICATIONS

Extended European Search Report dated Sep. 1, 2016, for European Application No. 16166585.6.
Shore Durometer Conversion Chart—Thermal Tech Equipment Co. Inc.

*Primary Examiner* — John E Simms, Jr.
(74) *Attorney, Agent, or Firm* — Birch, Stewart, Kolasch & Birch, LLP

(57) ABSTRACT

An object of the present invention is to provide a golf ball traveling a great distance on driver shots. The present invention provides a golf ball comprising a spherical core including an inner layer and an outer layer, an intermediate layer and a cover, wherein a difference ($H_{X+1}-H_{X-1}$) between a hardness ($H_{X+1}$) at a point outwardly away in a radial direction from a boundary between the inner layer and the outer layer of the spherical core by 1 mm and a hardness ($H_{X-1}$) at a point inwardly away in the radial direction from the boundary between the inner layer and the outer layer of the spherical core by 1 mm is 0 or more in Shore C hardness, a surface hardness ($H_{X+Y}$) of the spherical core is more than
(Continued)

65 in Shore C hardness, an angle α of a hardness gradient of the inner layer is 0° or more, a difference (α−β) between the angle α and an angle β of a hardness gradient of the outer layer is 0° or more, a total thickness of a thickness (Tm) of the intermediate layer and a thickness (Tc) of the cover is 3 mm or less, and the cover has a highest hardness among the constituent members of the golf ball.

19 Claims, 3 Drawing Sheets

(52) U.S. Cl.
CPC ..... *A63B 37/0039* (2013.01); *A63B 37/0043* (2013.01); *A63B 37/0044* (2013.01); *A63B 37/0045* (2013.01); *A63B 37/0062* (2013.01); *A63B 37/0063* (2013.01); *A63B 37/0064* (2013.01); *A63B 37/0076* (2013.01)

(56) References Cited

U.S. PATENT DOCUMENTS

2009/0270202 A1* 10/2009 Nakamura ..... A63B 37/0063 473/374
2010/0273575 A1* 10/2010 Watanabe ..... A63B 37/0003 473/373
2011/0159998 A1* 6/2011 Ohama ..... A63B 37/0062 473/374
2012/0238377 A1* 9/2012 Watanabe ..... A63B 37/0063 473/373
2012/0252604 A1 10/2012 Okabe et al.
2012/0270678 A1 10/2012 Umezawa et al.
2012/0270679 A1 10/2012 Umezawa et al.
2012/0270680 A1* 10/2012 Umezawa ..... A63B 37/06 473/376
2012/0270681 A1 10/2012 Umezawa et al.
2012/0329576 A1 12/2012 Sullivan et al.
2013/0137536 A1 5/2013 Sullivan
2013/0303308 A1* 11/2013 Isogawa ..... A63B 37/0043 473/373
2013/0324317 A1 12/2013 Sajima
2013/0324318 A1* 12/2013 Isogawa ..... A63B 37/0076 473/373
2013/0324319 A1* 12/2013 Sajima ..... A63B 37/0051 473/373
2014/0004974 A1* 1/2014 Ladd ..... A63B 37/0075 473/373
2014/0194221 A1* 7/2014 Watanabe ..... A63B 37/0092 473/373
2014/0309056 A1 10/2014 Sullivan
2015/0038266 A1* 2/2015 Watanabe ..... A63B 37/0058 473/373
2015/0119170 A1 4/2015 Tachibana et al.
2016/0184657 A1 6/2016 Tachibana et al.

FOREIGN PATENT DOCUMENTS

JP 2012-223569 A 11/2012
JP 2012-223570 A 11/2012
JP 2012-223571 A 11/2012
JP 2012-223572 A 11/2012

* cited by examiner

GOLF BALL

CROSS-REFERENCE TO RELATED APPLICATIONS

This application is a Continuation of copending application Ser. No. 15/132,909, filed on Apr. 19, 2016, which claims priority under 35 U.S.C. § 119(a) to Application No. 2015-090787, filed in Japan on Apr. 27, 2015, all of which are hereby expressly incorporated by reference into the present application.

FIELD OF THE INVENTION

The present invention relates to a golf ball.

DESCRIPTION OF THE RELATED ART

A golfer's foremost requirement for a golf ball is flight performance. An appropriate trajectory height is required in order to achieve a long flight distance. The trajectory height depends on a spin rate and a launch angle. The golf ball that achieves a high trajectory by a high spin rate travels an insufficient flight distance. The golf ball that achieves a high trajectory by a high launch angle travels a long flight distance. If a core having an outer-hard and inner-soft structure is adopted, a low spin rate and a high launch angle are achieved.

From the viewpoint of achieving these performances, various combinations of hardness gradients have been proposed with respect to multiple core layers. For example, Japanese Patent Publications No. 2012-223569 A, No. 2012-223570 A, No. 2012-223571 A and No. 2012-223572 A disclose a multi-piece solid golf ball comprising a solid core encased by a cover of one, two or more layers, the solid core comprising a spherical first layer, a second layer encasing the first layer and a third layer encasing the second layer, wherein the first layer has a diameter of from 3 to 24 mm; the third layer is formed of a rubber composition primarily composed of a polybutadiene rubber; and a relationship of respective hardness of a cross-sectional hardness at a center of the core on a cut face when the solid core has been cut in half, the first layer inside by 1 mm from a boundary between the first layer and the second layer, the second layer outside by 1 mm from the boundary, the second layer inside by 1 mm from a boundary between the second layer and the third layer, the third layer outside by 1 mm from the boundary and a surface of the third layer, is specified (refer to No. 2012-223569 A (paragraph 0007), No. 2012-223570 A (paragraph 0007), No. 2012-223571 A (paragraph 0007), and No. 2012-223572 A (paragraph 0007)).

Further, a technology of controlling a hardness distribution in a single-layered core has also been proposed. For example, Japanese Patent Publications No. 2008-212681 A discloses a golf ball comprising a crosslinked molded product of a rubber composition as a constituent element, wherein the rubber composition is obtained by blending a filler, an organic peroxide and an α, β-unsaturated carboxylic acid and/or a metal salt thereof as essential components, and further blending a copper salt of a saturated or unsaturated fatty acid, into a base rubber (refer to No. 2008-212681 A (claim 1, paragraph 0013)).

SUMMARY OF THE INVENTION

In recent years, the golfer's requirement for flight performance has been escalating, and a golf ball traveling a greater flight distance on driver shots is demanded. The present invention has been achieved in view of the above circumstances, and an object of the present invention is to provide a golf ball traveling a great distance on driver shots.

The present invention that has solved the above problems provides a golf ball comprising a spherical core, an intermediate layer positioned outside the spherical core, and a cover positioned outside the intermediate layer, wherein the spherical core includes an inner layer and an outer layer, a difference ($H_{X+1}-H_{X-1}$) between a hardness ($H_{X+1}$) at a point outwardly away in a radial direction from a boundary between the inner layer and the outer layer of the spherical core by 1 mm and a hardness ($H_{X-1}$) at a point inwardly away in the radial direction from the boundary between the inner layer and the outer layer of the spherical core by 1 mm is 0 or more in Shore C hardness, a surface hardness ($H_{X+Y}$) of the spherical core is more than 65 in Shore C hardness, an angle a of a hardness gradient of the inner layer calculated by a formula (1) is 0° or more, a difference (α−β) between the angle α and an angle β of a hardness gradient of the outer layer calculated by a formula (2) is 0° or more, a total thickness of a thickness (Tm) of the intermediate layer and a thickness (Tc) of the cover is 3 mm or less, and the cover has a highest hardness among the constituent members of the golf ball.

$$\alpha=(180/\pi)\times a\ \tan[\{H_{x-1}-Ho\}/(X-1)] \quad (1)$$

$$\beta=(180/\pi)\times a\ \tan[\{H_{X+Y}-H_{x+1}\}/(Y-1)] \quad (2)$$

[where X represents a radius (mm) of the inner layer, Y represents a thickness (mm) of the outer layer, Ho represents a center hardness (Shore C) of the spherical core, $H_{x-1}$ represents the hardness (Shore C) at the point inwardly away in the radial direction from the boundary between the inner layer and the outer layer of the spherical core by 1 mm, $H_{X+1}$ represents the hardness (Shore C) at the point outwardly away in the radial direction from the boundary between the inner layer and the outer layer of the spherical core by 1 mm, and $H_{X+Y}$ represents the surface hardness (Shore C) of the spherical core].

In the golf ball according to the present invention, the relationship between the hardness gradient of the inner layer and the hardness gradient of the outer layer of the spherical core, the relationship between the inner layer hardness and the outer layer hardness near the boundary between the inner layer and the outer layer of the spherical core, the total thickness of the intermediate layer and the cover, and the hardness of the cover are optimized. As a result, for the golf ball according to the present invention, the ball initial velocity on driver shots is increased and the excessive spin rate on driver shots is suppressed. Therefore, the golf ball according to the present invention travels a greater distance on driver shots.

The golf ball according to the present invention travels a great distance on driver shots.

DESCRIPTION OF THE PREFERRED EMBODIMENT

Figure 1:
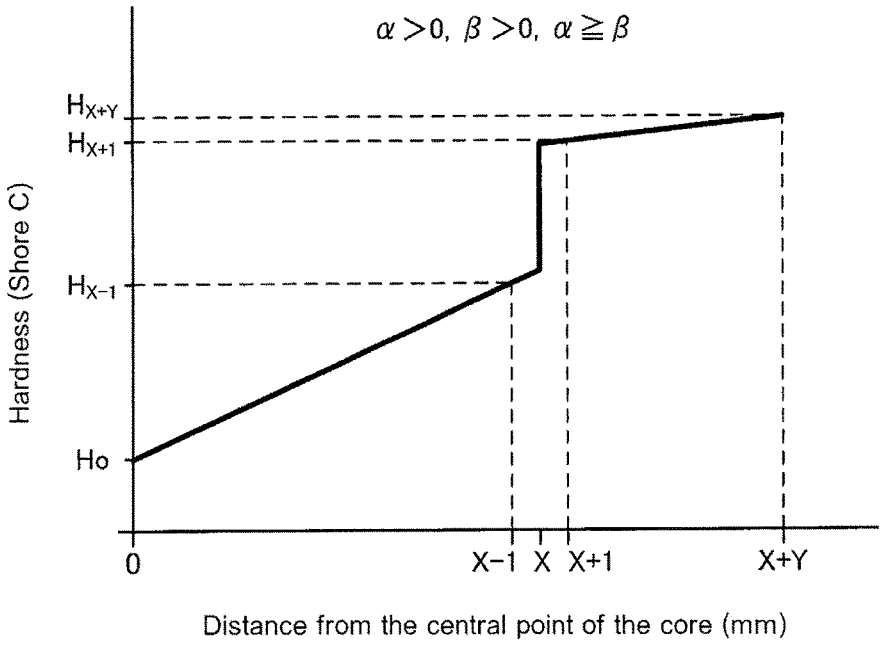
FIG. 1 is a drawing showing one example of a hardness distribution of a spherical core.
Figure 2:
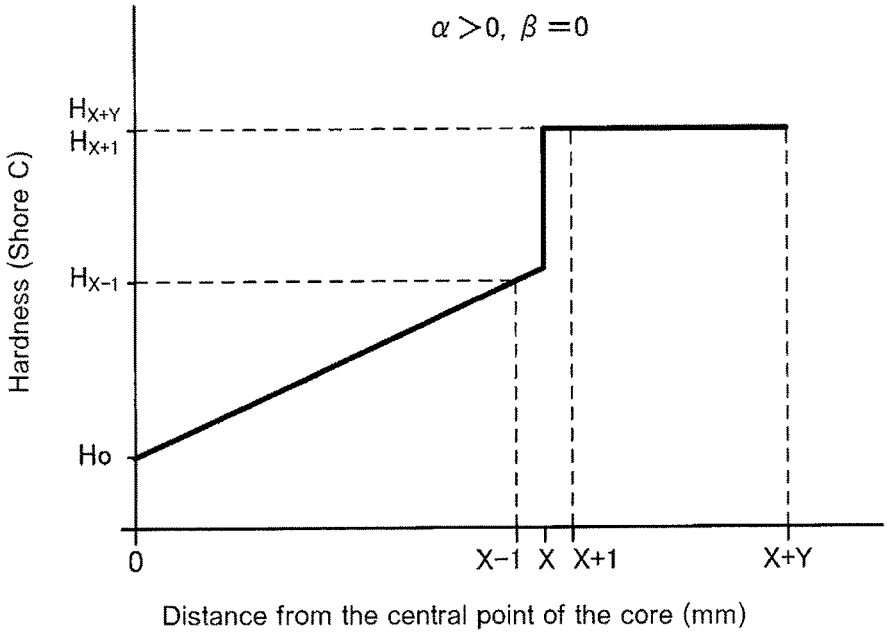
FIG. 2 is a drawing showing another example of a hardness distribution of a spherical core.
Figure 3:
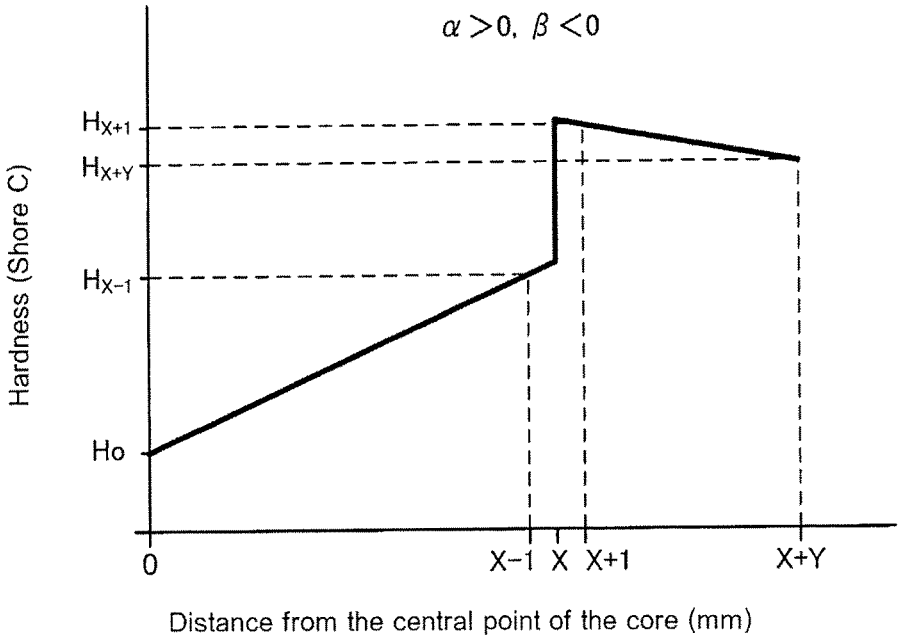
FIG. 3 is a drawing showing another example of a hardness distribution of a spherical core.
Figure 4:
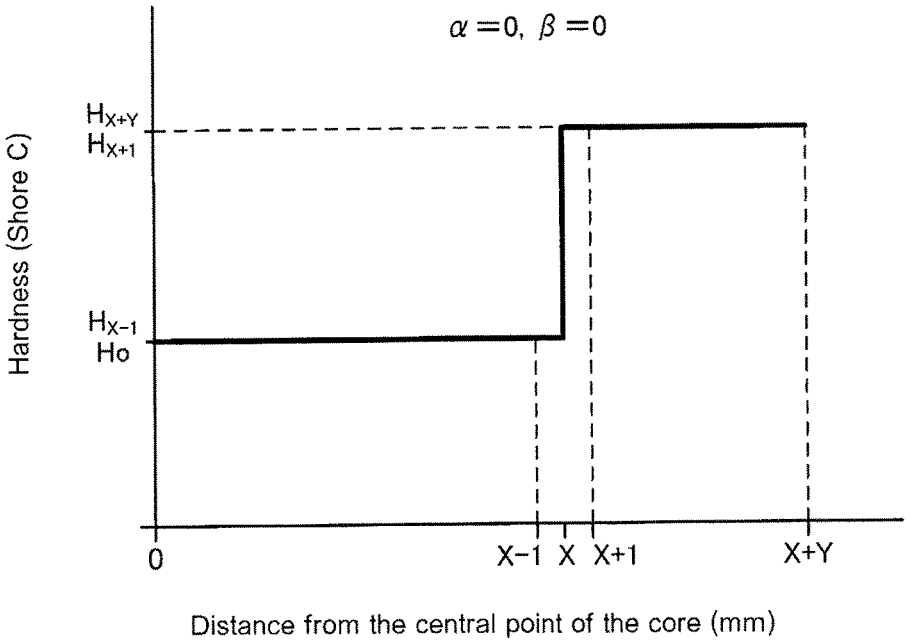
FIG. 4 is a drawing showing another example of a hardness distribution of a spherical core.

The golf ball according to the present invention comprises a spherical core, an intermediate layer positioned outside the spherical core, and a cover positioned outside the intermediate layer, wherein the spherical core includes an inner layer and an outer layer, a difference ($H_{X+1}-H_{X-1}$) between a hardness ($H_{X+1}$) at a point outwardly away in a radial direction from a boundary between the inner layer and the outer layer of the spherical core by 1 mm and a hardness ($H_{X-1}$) at a point inwardly away in the radial direction from the boundary between the inner layer and the outer layer of the spherical core by 1 mm is 0 or more in Shore C hardness, a surface hardness ($H_{X+Y}$) of the spherical core is more than 65 in Shore C hardness, an angle α of a hardness gradient of the inner layer calculated by a formula (1) is 0° or more, a difference (α−β) between the angle α and an angle β of a hardness gradient of the outer layer calculated by a formula (2) is 0° or more, a total thickness of a thickness (Tm) of the intermediate layer and a thickness (Tc) of the cover is 3 mm or less, and the cover has a highest hardness among the constituent members of the golf ball.

$$\alpha=(180/\pi)\times a\tan[\{H_{x-1}-Ho\}/(X-1)] \quad (1)$$

$$\beta=(180/\pi)\times a\tan[\{H_{X+Y}-H_{x+1}\}/(Y-1)] \quad (2)$$

[where X represents a radius (mm) of the inner layer, Y represents a thickness (mm) of the outer layer, Ho represents a center hardness (Shore C) of the spherical core, $H_{X+1}$ represents the hardness (Shore C) at the point inwardly away in the radial direction from the boundary between the inner layer and the outer layer of the spherical core by 1 mm, $H_{X+1}$ represents the hardness (Shore C) at the point outwardly away in the radial direction from the boundary between the inner layer and the outer layer of the spherical core by 1 mm, and $H_{X+Y}$ represents the surface hardness (Shore C) of the spherical core].

With such a configuration, the ball initial velocity can be increased while suppressing the excessive spin rate on driver shots.

[Construction]

(Spherical Core)

The spherical core includes a two-layered construction consisting of an inner layer and an outer layer. The spherical core is preferably formed from a rubber composition.

(Hardness Ho)

The center hardness Ho is a hardness (Shore C) measured at the central point of the cut plane obtained by cutting the spherical core into two hemispheres. The hardness Ho is preferably 48 or more, more preferably 49 or more, and even more preferably 50 or more, and is preferably less than 65, more preferably 64 or less, and even more preferably 63 or less. If the hardness Ho is 48 or more, the resilience performance is further enhanced, and if the hardness Ho is less than 65, the excessive spin rate on driver shots is suppressed.

(Hardness $H_{X-1}$)

The hardness $H_{X-1}$ is a hardness (Shore C) measured at the point inwardly away in the radial direction from the boundary between the inner layer and the outer layer by 1 mm on the cut plane obtained by cutting the spherical core into two hemispheres. In other words, the hardness $H_{X+1}$ is a hardness measured at a point having a distance of X−1 (mm) from the central point. The hardness $H_{X-1}$ is preferably 63 or more, more preferably 65 or more, and even more preferably 67 or more, and is preferably 82 or less, more preferably 80 or less, and even more preferably 78 or less. If the hardness $H_{X-1}$ is 63 or more, the resilience performance is enhanced, and if the hardness $H_{X-1}$ is 82 or less, the excessive spin rate on driver shots is suppressed.

(Hardness $H_{X+1}$)

The hardness $H_{X+1}$ is a hardness (Shore C) measured at the point outwardly away in the radial direction from the boundary between the inner layer and the outer layer by 1 mm on the cut plane obtained by cutting the spherical core into two hemispheres. In other words, the hardness $H_{X+1}$ is a hardness measured at a point having a distance of X+1 (mm) from the central point. The hardness $H_{X+1}$ is preferably 70 or more, more preferably 73 or more, and even more preferably 75 or more, and is preferably 90 or less, more preferably 88 or less, and even more preferably 86 or less. If the hardness $H_{X+1}$ is 70 or more, the resilience performance is enhanced, and if the hardness $H_{X+1}$ is 90 or less, the feeling becomes better.

(Hardness $H_{X+Y}$)

The hardness $H_{X+Y}$ is a hardness (Shore C) measured at the surface of the spherical core (outer core). The hardness $H_{X+Y}$ is more than 65, preferably 70 or more, more preferably 73 or more, and even more preferably 75 or more, and is preferably 90 or less, more preferably 88 or less, and even more preferably 86 or less. If the hardness $H_{X+Y}$ is more than 65, the resilience performance is enhanced, and if the hardness $H_{X+Y}$ is 90 or less, the feeling becomes better.

(Hardness Difference ($H_{X-1}$−Ho))

The hardness difference ($H_{X-1}$−Ho) between the center hardness Ho and the hardness $H_{X-1}$, i.e. the hardness difference between the center hardness of the inner layer and the hardness of the inner layer near the boundary is preferably 4 or more, more preferably 5 or more, and even more preferably 6 or more, and is preferably 27 or less, more preferably 26 or less, and even more preferably 25 or less. If the hardness difference ($H_{X-1}$−Ho) is 4 or more, the excessive spin rate on driver shots is suppressed, and if the hardness difference ($H_{X-1}$−Ho) is 27 or less, the resilience performance is enhanced.

(Hardness Difference ($H_{X+1}-H_{X-1}$))

The hardness difference ($H_{X+1}-H_{X-1}$) between the hardness $H_{X-1}$ and the hardness $H_{X+1}$, i.e. the hardness difference between the inner layer hardness and the outer layer hardness near the boundary between the inner layer and the outer layer is preferably 0 or more, more preferably 5 or more, even more preferably 7 or more, and particularly preferably 8 or more, and is preferably 20 or less, more preferably 18 or less, and even more preferably 16 or less. If the hardness difference ($H_{X+1}-H_{X-1}$) is 0 or more, the excessive spin rate on driver shots is suppressed, and if the hardness difference ($H_{X+1}-H_{X-1}$) is 20 or less, the durability is enhanced.

(Hardness Difference ($H_{X+Y}-H_{X+1}$))

The hardness difference ($H_{X+Y}-H_{X+1}$) between the hardness $H_{X+1}$ and the surface hardness $H_{X+Y}$, i.e. the hardness difference between the outer layer hardness near the boundary and the surface hardness of the outer layer is preferably −7 or more, more preferably −6 or more, and even more preferably −5 or more, and is preferably 10 or less, more preferably 7 or less, and even more preferably 5 or less. If the hardness difference ($H_{X+Y}-H_{X+1}$) is −7 or more, the excessive spin rate on driver shots is suppressed, and if the hardness difference ($H_{X+Y}-H_{X+1}$) is 10 or less, the resilience performance is enhanced.

(Hardness Difference ($H_{X+Y}$–Ho))

The hardness difference ($H_{X+Y}$–Ho) between the center hardness Ho and the surface hardness $H_{X+Y}$, i.e. the hardness difference between the center hardness and the surface hardness of the spherical core is preferably 14 or more, more preferably 16 or more, and even more preferably 18 or more, and is preferably 35 or less, more preferably 33 or less, and even more preferably 30 or less. If the hardness difference ($H_{X+Y}$–Ho) is 14 or more, the excessive spin rate on driver shots is suppressed, and if the hardness difference ($H_{X+Y}$–Ho) is 35 or less, the durability is enhanced.

(Angle α)

The angle α is calculated by a formula (1). The angle α (°) represents a hardness gradient of the inner layer. The angle α is preferably 0° or more, more preferably 15° or more, and even more preferably 20° or more, and is preferably 75° or less, more preferably 73° or less, and even more preferably 70° or less. If the angle α is 0° or more, the excessive spin rate on driver shots is suppressed, and if the angle α is 75° or less, the resilience performance is enhanced.

(Angle β)

The angle β is calculated by a formula (2). The angle β (°) represents a hardness gradient of the outer layer. The angle β is preferably −20° or more, more preferably −19° or more, and even more preferably −18° or more, and is preferably +20° or less, more preferably +19° or less, and even more preferably +18° or less. If the angle β is −20° or more, the excessive spin rate on driver shots is suppressed, and if the angle β is +20° or less, the resilience performance is enhanced.

(Angle Difference (α−β))

Figure 5:
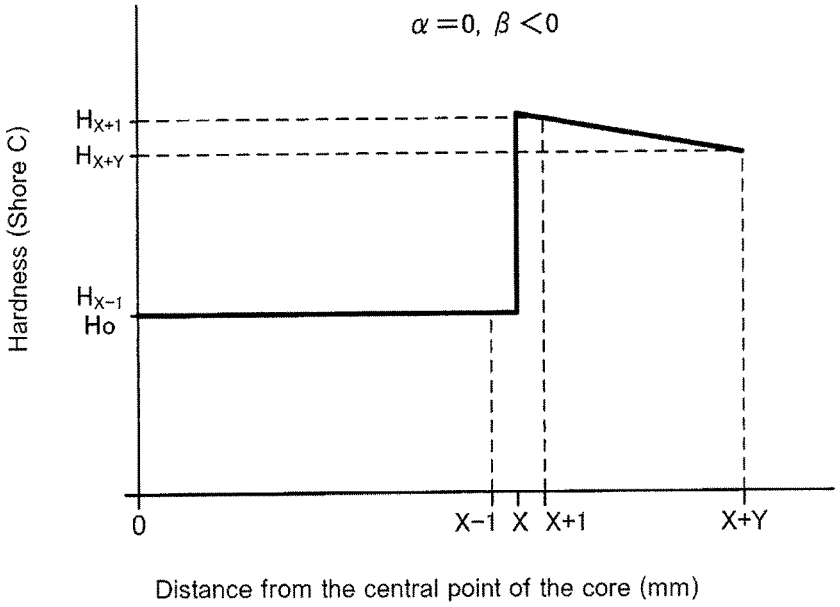
FIG. 5 is a drawing showing another example of a hardness distribution of a spherical core.

The difference (α−β) between the angle α and the angle β is 0° or more. Examples of the embodiment in which the difference (α−β) is 0° or more are shown in FIG. 1 to FIG. 5. FIG. 1 to FIG. 5 show examples of the hardness distribution of the spherical core. Examples of the embodiment in which the difference (α−β) is 0° or more include an embodiment in which the angle α and the angle β are positive, and the angle β is equal to or less than the angle α (FIG. 1); an embodiment in which the angle α is positive and the angle β is 0° (FIG. 2); an embodiment in which the angle α is positive and the angle β is negative (FIG. 3); an embodiment in which both the angle α and the angle β are 0° (FIG. 4); and an embodiment in which the angle α is 0° and the angle β is negative (FIG. 5). With such a configuration, the ball initial velocity can be increased while suppressing the excessive spin rate on driver shots.

The difference (α−β) is preferably 5 or more, more preferably 10 or more, and is preferably 85 or less, more preferably 80 or less, and even more preferably 75 or less. If the difference (α−β) is 85 or less, the resilience performance is enhanced.

(Radius X of Inner Layer)

The radius X is the radius (mm) of the inner layer of the core. The inner layer of the core preferably has a spherical shape. The radius X is preferably 7 mm or more, more preferably 9 mm or more, and even more preferably 10 mm or more, and is preferably 16 mm or less, more preferably 15 mm or less, and even more preferably 14 mm or less. If the radius X is 7 mm or more, the excessive spin rate on driver shots can be suppressed, and if the radius X is 16 mm or less, the resilience performance is enhanced.

(Thickness Y of Outer Layer)

The thickness Y is the thickness (mm) of the outer layer of the core. The thickness Y is preferably 3 mm or more, more preferably 4 mm or more, and even more preferably 5 mm or more, and is preferably 12 mm or less, more preferably 11 mm or less, and even more preferably 10 mm or less. If the thickness Y is 3 mm or more, the resilience performance becomes better, and if the thickness Y is 12 mm or less, the excessive spin rate on driver shots is suppressed.

(Ratio (Y/X))

The ratio (Y/X) of the thickness Y to the radius X is preferably 0.2 or more, more preferably 0.3 or more, and even more preferably 0.4 or more, and is preferably 2.0 or less, more preferably 1.7 or less, and even more preferably 1.5 or less. If the ratio (Y/X) is 0.2 or more, the resilience performance becomes better, and if the ratio (Y/X) is 2.0 or less, the excessive spin rate on driver shots is suppressed.

The diameter of the spherical core is preferably 36.5 mm or more, more preferably 37.0 mm or more, and even more preferably 37.5 mm or more, and is preferably 42.0 mm or less, more preferably 41.0 mm or less, and even more preferably 40.2 mm or less. If the diameter of the spherical core is 36.5 mm or more, the spherical core is big and thus the resilience performance of the golf ball is further enhanced.

When the spherical core has a diameter ranging from 36.5 mm to 42.0 mm, the compression deformation amount of the core (shrinking amount of the core along the compression direction) when applying a load from 98 N as an initial load to 1275 N as a final load to the core is preferably 2.0 mm or more, more preferably 2.5 mm or more, and is preferably 4.8 mm or less, more preferably 4.5 mm or less. If the compression deformation amount is 2.0 mm or more, the shot feeling becomes better, and if the compression deformation amount is 4.8 mm or less, the resilience performance becomes better.

(Intermediate Layer)

The golf ball comprises an intermediate layer positioned outside the spherical core. The intermediate layer may comprise a single layer, or two or more layers. The intermediate layer is preferably formed from a resin composition.

The hardness Hm (Shore C) of the intermediate layer is preferably 60 or more, more preferably 62 or more, and even more preferably 64 or more, and is preferably 85 or less, more preferably 83 or less, and even more preferably 81 or less. If the intermediate layer has a hardness of 60 or more, the ball initial velocity on driver shots increases and the spin rate on driver shots decreases. If the intermediate layer has a hardness of 85 or less, the shot feeling becomes better. The hardness of the intermediate layer is a slab hardness of a material for forming the intermediate layer.

The hardness difference (Hm−$H_{x+y}$) between the hardness Hm of the intermediate layer and the surface hardness $H_{x+y}$ of the spherical core is preferably −35 or more, more preferably −30 or more, and even more preferably −25 or more, and is preferably 1 or less, more preferably −5 or less, and even more preferably −10 or less. If the hardness difference (Hm−$H_{x+y}$) is −35 or more, the difference between the surface hardness of the spherical core and the hardness of the intermediate layer is not excessively large, and thus the shot feeling becomes better. In addition, if the hardness difference (Hm−$H_{x+y}$) is 1 or less, the shot feeling becomes better. In the case that the intermediate layer comprises multiple layers, the hardness difference (Hm−$H_{x+y}$) means the hardness difference between the hardness of the innermost intermediate layer and the surface hardness of the spherical core.

The intermediate layer preferably has a thickness Tm of 0.5 mm or more, more preferably 0.6 mm or more, and even more preferably 0.7 mm or more, and preferably has a thickness Tm of 2.0 mm or less, more preferably 1.9 mm or less, and even more preferably 1.8 mm or less. If the intermediate layer has a thickness of 0.5 mm or more, the durability becomes better, and if the intermediate layer has a thickness of 2.0 mm or less, the resilience performance is enhanced. In the case that the intermediate layer comprises multiple layers, the total thickness thereof may be adjusted within the above range.

(Cover)

The golf ball comprises a cover positioned outside the intermediate layer. The cover constitutes the outermost layer of the golf ball body, and is formed from a resin composition.

The cover has a highest hardness among the constituent members of the golf ball. In other words, the hardness Hc of the cover is highest among the center hardness Ho of the spherical core, the hardness $H_{X+1}$ at the point outwardly away in the radial direction from the boundary between the inner layer and the outer layer of the spherical core by 1 mm, the hardness $H_{X-1}$ at the point inwardly away in the radial direction from the boundary between the inner layer and the outer layer of the spherical core by 1 mm, the surface hardness $H_{X+Y}$ of the spherical core, the hardness Hm of the intermediate layer, and the hardness Hc of the cover. If the hardness Hc of the cover has a highest hardness, the excessive spin rate on driver shots can be suppressed, and thus the golf ball travels a greater distance.

The hardness Hc (Shore C) of the cover is preferably 75 or more, more preferably 77 or more, and even more preferably 79 or more, and is preferably 98 or less, more preferably 96 or less. If the hardness of the cover is 75 or more, the ball initial velocity on driver shots increases and the spin rate on driver shots decreases. In addition, if the hardness of the cover is 98 or less, the shot feeling becomes better. The hardness of the cover is a slab hardness of a material for forming the cover.

The hardness difference (Hc−Hm) between the hardness Hc of the cover and the hardness Hm of the intermediate layer is preferably 5 or more, more preferably 6 or more, and even more preferably 7 or more, and is preferably 31 or less, more preferably 30 or less, and even more preferably 29 or less. If the hardness difference (Hc−Hm) is 5 or more, the shot feeling becomes better. In addition, if the hardness difference (Hc−Hm) is 31 or less, the ball initial velocity on driver shots increases. In the case that the intermediate layer comprises multiple layers, the hardness difference (Hc−Hm) means the hardness difference between the hardness of the innermost intermediate layer and the hardness of the cover.

The hardness difference ($Hc-H_{x+y}$) between the hardness Hc of the cover and the surface hardness $H_{x+y}$ of the spherical core is preferably 1 or more, more preferably 2 or more, and even more preferably 3 or more, and is preferably 16 or less, more preferably 15 or less, and even more preferably 14 or less. If the hardness difference ($Hc-H_{x+y}$) is 1 or more, the ball initial velocity on driver shots increases. In addition, if the hardness difference ($Hc-H_{x+y}$) is 16 or less, the shot feeling becomes better.

The cover preferably has a thickness Tc of 0.5 mm or more, more preferably 0.6 mm or more, and even more preferably 0.7 mm or more, and preferably has a thickness Tc of 2.5 mm or less, more preferably 2.4 mm or less, and even more preferably 2.3 mm or less. If the cover has a thickness of 0.5 mm or more, the cover is easily molded and exhibits an enhanced crack resistance. In addition, if the cover has a thickness of 2.5 mm or less, the shot feeling becomes better.

The total thickness (Tc+Tm) of the thickness Tc of the cover and the thickness Tm of the intermediate layer is preferably 3 mm or less, more preferably 2.9 mm or less, and even more preferably 2.8 mm or less. If the total thickness (Tc+Tm) is 3 mm or less, the golf ball shows a better shot feeling.

The ratio (Tc/Tm) of the thickness Tc of the cover to the thickness Tm of the intermediate layer is preferably 1.00 or more, more preferably 1.05 or more, and even more preferably 1.10 or more, and is preferably 5.00 or less, more preferably 4.90 or less, and even more preferably 4.80 or less. If the ratio (Tc/Tm) is 1.00 or more, the ball initial velocity on driver shots increases and the spin rate on driver shots decreases. In addition, if the ratio (Tc/Tm) is 5.00 or less, the shot feeling becomes better.

(Reinforcing Layer)

The golf ball may comprise a reinforcing layer between the intermediate layer and the cover. If the reinforcing layer is comprised, the adhesion between the intermediate layer and the cover increases, and thus the durability of the golf ball is enhanced. The reinforcing layer preferably has a thickness of 3 μm or more, more preferably 5 μm or more, and preferably has a thickness of 100 μm or less, more preferably 50 μm or less, and even more preferably 20 μm or less.

The golf ball preferably has a diameter ranging from 40 mm to 45 mm. In light of satisfying the regulation of US Golf Association (USGA), the diameter is particularly preferably 42.67 mm or more. In light of prevention of the air resistance, the diameter is more preferably 44 mm or less, and particularly preferably 42.80 mm or less. In addition, the golf ball preferably has a mass of 40 g or more and 50 g or less. In light of obtaining greater inertia, the mass is more preferably 44 g or more, and particularly preferably 45.00 g or more. In light of satisfying the regulation of USGA, the mass is particularly preferably 45.93 g or less.

When the golf ball has a diameter ranging from 40 mm to 45 mm, the compression deformation amount of the golf ball (shrinking amount of the golf ball along the compression direction) when applying a load from 98 N as an initial load to 1275 N as a final load to the golf ball is preferably 1.5 mm or more, more preferably 1.6 mm or more, even more preferably 1.7 mm or more, and most preferably 1.8 mm or more, and is preferably 3.0 mm or less, more preferably 2.9 mm or less. If the compression deformation amount is 1.5 mm or more, the golf ball does not become excessively hard, and thus the shot feeling thereof is good. On the other hand, if the compression deformation amount is 3.0 mm or less, the resilience becomes high.

Examples of the golf ball according to the present invention include a four-piece golf ball comprising a two-layered spherical core, a single intermediate layer covering the spherical core, and a cover covering the intermediate layer; a five-piece golf ball comprising a two-layered spherical core, two intermediate layers covering the spherical core, and a cover covering the intermediate layers; and a golf ball having six pieces or more comprising a two-layered spherical core, three or more intermediate layers covering the spherical core, and a cover covering the intermediate layers. The present invention can be applied appropriately to any one of the above golf balls.

Figure 6:
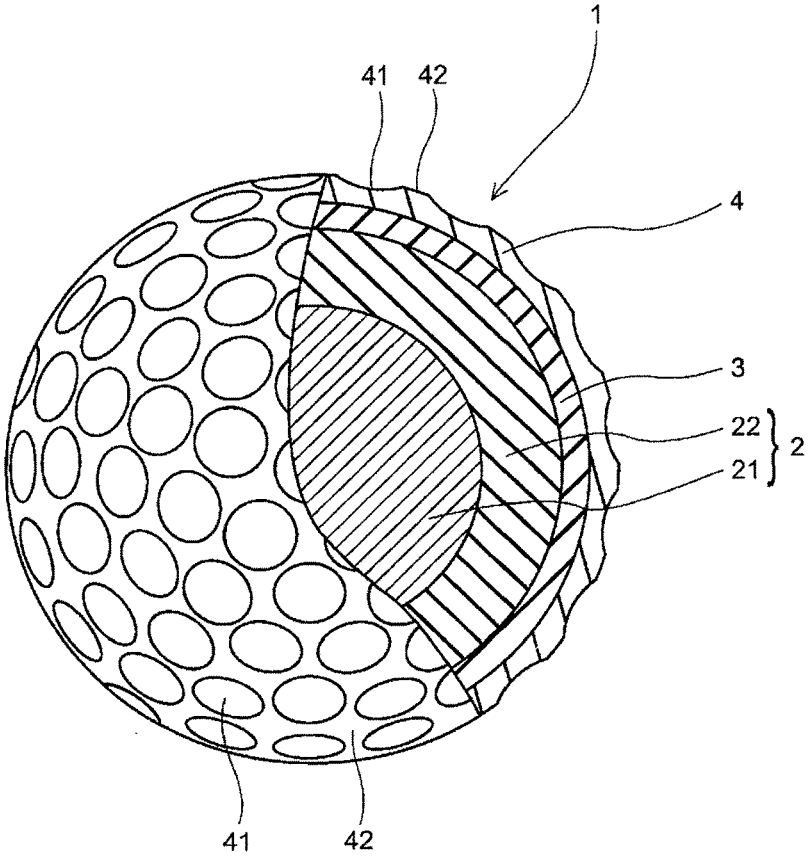
FIG. 6 is a partially cutaway sectional view showing a golf ball of one embodiment according to the present invention.

FIG. 6 is a partially cutaway sectional view showing a golf ball 1 according to one embodiment of the present invention. The golf ball 1 comprises a spherical core 2, an intermediate layer 3 positioned outside the spherical core 2, and a cover 4 positioned outside the intermediate layer 3. The spherical core 2 comprises an inner layer 21 and an outer layer 22 positioned outside the inner layer 21. A plurality of dimples 41 are formed on the surface of the cover 4. Other portions than dimples 41 on the surface of the cover 4 are lands 42.

[Material]

The core, intermediate layer and cover of the golf ball may employ conventionally known materials.

The core may employ a conventionally known rubber composition (hereinafter, sometimes simply referred to as "core rubber composition"), and can be formed by, for example, heat-pressing a rubber composition containing a base rubber, a co-crosslinking agent, and a crosslinking initiator.

As the base rubber, typically preferred is a high cis-polybutadiene having cis-bond in a proportion of 40 mass % or more, more preferably 70 mass % or more, and even more preferably 90 mass % or more in view of its superior resilience property. The co-crosslinking agent is preferably an α,β-unsaturated carboxylic acid having 3 to 8 carbon atoms or a metal salt thereof, and more preferably a metal salt of acrylic acid or a metal salt of methacrylic acid. The metal constituting the metal salt is preferably zinc, magnesium, calcium, aluminum or sodium, more preferably zinc. The amount of the co-crosslinking agent is preferably 20 parts by mass or more and 50 parts by mass or less with respect to 100 parts by mass of the base rubber. When the α,β-unsaturated carboxylic acid having 3 to 8 carbon atoms is used as the co-crosslinking agent, a metal compound (e.g. magnesium oxide) is preferably used in combination. As the crosslinking initiator, an organic peroxide is preferably used. Specific examples of the organic peroxide include dicumyl peroxide, 1,1-bis(t-butylperoxy)-3,3,5-trimethylcyclohexane, 2,5-dimethyl-2,5-di(t-butylperoxy)hexane, and di-t-butyl peroxide. Among them, dicumyl peroxide is preferably used. The amount of the crosslinking initiator is preferably 0.2 part by mass or more, more preferably 0.3 part by mass or more, and is preferably 3 parts by mass or less, more preferably 2 parts by mass or less, with respect to 100 parts by mass of the base rubber.

Further, the core rubber composition may further contain an organic sulfur compound. As the organic sulfur compound, diphenyl disulfides (e.g. diphenyl disulfide, bis (pentabromophenyl) persulfide), thiophenols, and thionaphthols (e.g. 2-thionaphthol) are preferably used. The amount of the organic sulfur compound is preferably 0.1 part by mass or more, more preferably 0.3 part by mass or more, and is preferably 5.0 parts by mass or less, more preferably 3.0 parts by mass or less, with respect to 100 parts by mass of the base rubber. In addition, the core rubber composition may further contain a carboxylic acid and/or a salt thereof. As the carboxylic acid and/or the salt thereof, a carboxylic acid having 1 to 30 carbon atoms and/or a salt thereof is preferred. As the carboxylic acid, an aliphatic carboxylic acid or an aromatic carboxylic acid (such as benzoic acid) can be used. The amount of the carboxylic acid and/or the salt thereof is preferably 1 part by mass or more and 40 parts by mass or less with respect to 100 parts by mass of the base rubber.

The intermediate layer and the cover are formed from a resin composition. The resin composition includes a thermoplastic resin as a resin component. Examples of the thermoplastic resin include an ionomer resin, a thermoplastic olefin copolymer, a thermoplastic polyamide, a thermoplastic polyurethane, a thermoplastic styrene resin, a thermoplastic polyester, a thermoplastic acrylic resin, a thermoplastic polyolefin, a thermoplastic polydiene, and a thermoplastic polyether. Among the thermoplastic resin, a thermoplastic elastomer having rubber elasticity is preferred. Examples of the thermoplastic elastomer include a thermoplastic polyurethane elastomer, a thermoplastic polyamide elastomer, a thermoplastic styrene elastomer, a thermoplastic polyester elastomer, and a thermoplastic acrylic elastomer.

(Ionomer Resin)

Examples of the ionomer resin include an ionomer resin consisting of a metal ion-neutralized product of a binary copolymer composed of an olefin and an α,β-unsaturated carboxylic acid having 3 to 8 carbon atoms (hereinafter, sometimes referred to as "binary ionomer resin".); an ionomer resin consisting of a metal ion-neutralized product of a ternary copolymer composed of an olefin, an α, β-unsaturated carboxylic acid having 3 to 8 carbon atoms, and an α,β-unsaturated carboxylic acid ester (hereinafter, sometimes referred to as "ternary ionomer resin".); and a mixture of these ionomer resins.

The olefin is preferably an olefin having 2 to 8 carbon atoms, and examples thereof include ethylene, propylene, butene, pentene, hexene, heptene, and octene. Among them, ethylene is preferred. Examples of the α,β-unsaturated carboxylic acid having 3 to 8 carbon atoms include acrylic acid, methacrylic acid, fumaric acid, maleic acid and crotonic acid. Among them, acrylic acid and methacrylic acid are preferred.

As the α,β-unsaturated carboxylic acid ester, an alkyl ester of an α,β-unsaturated carboxylic acid having 3 to 8 carbon atoms is preferred, an alkyl ester of acrylic acid, methacrylic acid, fumaric acid or maleic acid is more preferred, and an alkyl ester of acrylic acid or an alkyl ester of methacrylic acid is particularly preferred. Examples of the alkyl group constituting the ester include methyl ester, ethyl ester, propyl ester, n-butyl ester, and isobutyl ester.

As the binary ionomer resin, a metal ion-neutralized product of an ethylene-(meth)acrylic acid binary copolymer is preferred. As the ternary ionomer resin, a metal ion-neutralized product of a ternary copolymer composed of ethylene, (meth)acrylic acid and (meth)acrylic acid ester is preferred. Herein, (meth)acrylic acid means acrylic acid and/or methacrylic acid.

Examples of the metal ion for neutralizing at least a part of carboxyl groups of the binary ionomer resin and/or the ternary ionomer resin include a monovalent metal ion such as sodium, potassium and lithium; a divalent metal ion such as magnesium, calcium, zinc, barium and cadmium; a trivalent metal ion such as aluminum; and other metal ion such as tin and zirconium. The binary ionomer resin and the ternary ionomer resin are preferably neutralized with at least one metal ion selected from the group consisting of $Na^+$, $Mg^{2+}$, $Ca^{2+}$ and $Zn^{2+}$.

Examples of the binary ionomer resin include Himilan (registered trademark) 1555 (Na), 1557 (Zn), 1605 (Na), 1706 (Zn), 1707 (Na), AM7311 (Mg), AM7329 (Zn) and AM7337 (commercially available from Du Pont-Mitsui Polychemicals Co., Ltd.); Surlyn (registered trademark) 8945 (Na), 9945 (Zn), 8140 (Na), 8150 (Na), 9120 (Zn), 9150 (Zn), 6910 (Mg), 6120 (Mg), 7930 (Li), 7940 (Li) and AD8546 (Li) (commercially available from E.I. du Pont de Nemours and Company); and Iotek (registered trademark) 8000 (Na), 8030 (Na), 7010 (Zn), 7030 (Zn) (commercially available from ExxonMobil Chemical Corporation).

Examples of the ternary ionomer resin include Himilan AM7327 (Zn), 1855 (Zn), 1856 (Na) and AM7331 (Na) (commercially available from Du Pont-Mitsui Polychemicals Co., Ltd.); Surlyn 6320 (Mg), 8120 (Na), 8320 (Na), 9320 (Zn), 9320W (Zn), HPF1000 (Mg) and HPF2000 (Mg) (commercially available from E.I. du Pont de Nemours and Company); and Iotek 7510 (Zn) and 7520 (Zn) (commercially available from ExxonMobil Chemical Corporation).

(Thermoplastic Olefin Copolymer)

Examples of the thermoplastic olefin copolymer include a binary copolymer composed of an olefin and an α,β-unsaturated carboxylic acid having 3 to 8 carbon atoms (hereinafter, sometimes referred to as "binary copolymer".); a ternary copolymer composed of an olefin, an α,β-unsaturated carboxylic acid having 3 to 8 carbon atoms and an α,β-unsaturated carboxylic acid ester (hereinafter, sometimes referred to as "ternary copolymer".); and a mixture of these copolymers. The thermoplastic olefin copolymer is a nonionic copolymer having carboxyl groups not being neutralized.

Examples of the olefin include those olefins used for constituting the ionomer resin. In particular, ethylene is preferred. Examples of the α,β-unsaturated carboxylic acid having 3 to 8 carbon atoms and the ester thereof include those α,β-unsaturated carboxylic acids having 3 to 8 carbon atoms and the esters thereof used for constituting the ionomer resin.

As the binary copolymer, a binary copolymer composed of ethylene and (meth)acrylic acid is preferred. As the ternary copolymer, a ternary copolymer composed of ethylene, (meth)acrylic acid and (meth)acrylic acid ester is preferred.

Examples of the binary copolymer include Nucrel (registered trademark) N1050H, N2050H, N1110H and N0200H (commercially available from Du Pont-Mitsui Polychemicals Co., Ltd.); and Primacor (registered trademark) 5980I (commercially available from Dow Chemical Company). Examples of the ternary copolymer include Nucrel AN4318 and AN4319 (commercially available from Du Pont-Mitsui Polychemicals Co., Ltd.); and Primacor AT310 and AT320 (commercially available from Dow Chemical Company).

(Thermoplastic Styrene Elastomer)

As the thermoplastic styrene elastomer, a thermoplastic elastomer containing a styrene block is preferably used. The thermoplastic elastomer containing a styrene block includes a polystyrene block that is a hard segment, and a soft segment. The typical soft segment is a diene block. Examples of the constituent component of the diene block include butadiene, isoprene, 1,3-pentadiene and 2,3-dimethyl-1,3-butadiene. Among them, butadiene and isoprene are preferred. Two or more constituent components may be used in combination.

Examples of the thermoplastic elastomer containing a styrene block include a styrene-butadiene-styrene block copolymer (SBS), a styrene-isoprene-styrene block copolymer (SIS), a styrene-isoprene-butadiene-styrene block copolymer (SIBS), a hydrogenated product of SBS, a hydrogenated product of SIS and a hydrogenated product of SIBS. Examples of the hydrogenated product of SBS include a styrene-ethylene-butylene-styrene block copolymer (SEBS). Examples of the hydrogenated product of SIS include a styrene-ethylene-propylene-styrene block copolymer (SEPS). Examples of the hydrogenated product of SIBS include a styrene-ethylene-ethylene-propylene-styrene block copolymer (SEEPS).

The content of the styrene component in the thermoplastic elastomer containing a styrene block is preferably 10 mass % or more, more preferably 12 mass % or more, and particularly preferably 15 mass % or more. In light of the shot feeling of the obtained golf ball, the content is preferably 50 mass % or less, more preferably 47 mass % or less, and particularly preferably 45 mass % or less.

Examples of the thermoplastic elastomer containing a styrene block include an alloy of one kind or two or more kinds selected from the group consisting of SBS, SIS, SIBS, SEBS, SEPS, SEEPS and the hydrogenated products thereof with a polyolefin. It is estimated that the olefin component in the alloy contributes to the improvement in compatibility with the ionomer resin. By using the alloy, the resilience performance of the golf ball becomes high. An olefin having 2 to 10 carbon atoms is preferably used. Appropriate examples of the olefin include ethylene, propylene, butane and pentene. Ethylene and propylene are particularly preferred.

Specific examples of the polymer alloy include Rabalon (registered trademark) T3221C, T3339C, SJ4400N, SJ5400N, SJ6400N, SJ7400N, SJ8400N, SJ9400N, and SR04 (commercially available from Mitsubishi Chemical Corporation). Examples of the thermoplastic elastomer containing a styrene block include Epofriend A1010 (commercially available from Daicel Chemical Industries, Ltd.), and Septon HG-252 (commercially available from Kuraray Co., Ltd.).

(Thermoplastic Polyurethane and Thermoplastic Polyurethane Elastomer)

Examples of the thermoplastic polyurethane and the thermoplastic polyurethane elastomer include a thermoplastic resin and a thermoplastic elastomer having a plurality of urethane bonds in the main molecular chain thereof. The polyurethane is preferably a product obtained by a reaction between a polyisocyanate component and a polyol component. Examples of the thermoplastic polyurethane elastomer include Elastollan (registered trademark) NY84A10, XNY85A, XNY90A, XNY97A, ET885 and ET890 (commercially available from BASF Japan Ltd.).

The resin composition may further include an additive, for example, a pigment component such as a white pigment (e.g. titanium oxide) and a blue pigment, a weight adjusting agent, a dispersant, an antioxidant, an ultraviolet absorber, a light stabilizer, a fluorescent material or a fluorescent brightener. Examples of the weight adjusting agent include an inorganic filler such as zinc oxide, barium sulfate, calcium carbonate, magnesium oxide, tungsten powder, and molybdenum powder.

The content of the white pigment (e.g. titanium oxide) is preferably 0.05 part by mass or more, more preferably 1 part by mass or more, and is preferably 10 parts by mass or less, more preferably 8 parts by mass or less, with respect to 100 parts by mass of the thermoplastic resin. If the content of the white pigment is 0.05 part by mass or more, it is possible to impart the opacity to the obtained golf ball constituent member. If the content of the white pigment is more than 10 parts by mass, the durability of the obtained golf ball constituent member may deteriorate.

The resin composition can be obtained, for example, by dry blending the thermoplastic resin and the additive. Further, the dry blended mixture may be extruded into a pellet form. Dry blending is preferably carried out by using for example, a mixer capable of blending raw materials in a pellet form, more preferably carried out by using a tumbler type mixer. Extruding can be carried out by using a publicly known extruder such as a single-screw extruder, a twin-screw extruder, and a twin-single screw extruder.

The resin composition used for the intermediate layer preferably includes an ionomer resin as a resin component, particularly preferably includes a binary ionomer resin as the resin component. If the intermediate layer material includes the ionomer resin, the resilience of the intermediate layer is further enhanced, and thus the flight distance on driver shots becomes greater. The content of the ionomer resin in the resin component of the resin composition used for the intermediate layer is preferably 50 mass % or more, more preferably 65 mass % or more, and even more preferably 70 mass % or more. Further, the resin composition used for the intermediate layer also preferably includes an ionomer resin and a thermoplastic elastomer containing a styrene block as a resin component.

The resin composition used for the cover preferably includes an ionomer resin, particularly a binary ionomer resin as a resin component. If the cover material includes an ionomer resin, the resilience of the cover is further enhanced, and thus the flight distance on driver shots becomes greater. The content of the ionomer resin in the resin component of the resin composition used for the cover is preferably 50 mass % or more, more preferably 65 mass % or more, and even more preferably 70 mass % or more.

In addition, the resin composition used for the intermediate layer also preferably includes an ionomer resin and a thermoplastic elastomer containing a styrene block as a resin component. In this case, the mass ratio (ionomer resin/thermoplastic elastomer containing a styrene block) of the ionomer resin to the thermoplastic elastomer containing a styrene block in the resin component is preferably 1.3 or more, more preferably 1.5 or more, and is preferably 6.0 or less, more preferably 5.8 or less.

The reinforcing layer is formed from a reinforcing layer composition containing a resin component. A two-component curing type thermosetting resin is preferably used as the resin component. Specific examples of the two-component curing type thermosetting resin include an epoxy resin, a urethane resin, an acrylic resin, a polyester resin, and a cellulose resin. In light of the strength and the durability of the reinforcing layer, the two-component curing type epoxy resin and the two-component curing type urethane resin are preferred.

The reinforcing layer composition may further include an additive such as a coloring material (e.g. titanium dioxide), a phosphoric acid stabilizer, an antioxidant, a light stabilizer, a fluorescent brightener, an ultraviolet absorber, and an anti-blocking agent. The additive may be added into the base agent or the curing agent of the two-component curing type thermosetting resin.

[Production Method]

The molding conditions for heat-pressing the core rubber composition should be determined appropriately depending on the formulation of the rubber composition. Generally, it is preferred that the molding is carried out by heating the core rubber composition at a temperature ranging from 130° C. to 200° C. for 10 minutes to 60 minutes, alternatively, by molding the core rubber composition in a two-step heating, i.e. at a temperature ranging from 130° C. to 150° C. for 20 minutes to 40 minutes, and then at a temperature ranging from 160° C. to 180° C. for 5 minutes to 15 minutes.

The method for molding the intermediate layer is not limited, and examples thereof include a method of molding the resin composition into hemispherical half shells in advance, covering the core with two of the half shells, and performing compression molding; and a method of injection molding the resin composition directly onto the core to cover the core.

When injection molding the resin composition onto the core to mold the intermediate layer, it is preferred to use upper and lower molds having a hemispherical cavity. Injection molding of the intermediate layer can be carried out by protruding the hold pin to hold the spherical body to be covered, charging the heated and melted resin composition, and then cooling to obtain the intermediate layer.

When molding the intermediate layer by the compression molding method, the half shell can be molded by either the compression molding method or the injection molding method, but the compression molding method is preferred. Compression molding the resin composition into half shells can be carried out, for example, under a pressure of 1 MPa or more and 20 MPa or less at a molding temperature of −20° C. or more and 70° C. or less relative to the flow beginning temperature of the resin composition. By carrying out the molding under the above conditions, the half shells with a uniform thickness can be formed. Examples of the method for molding the intermediate layer with half shells include a method of covering the spherical body with two of the half shells and then performing compression molding. Compression molding the half shells into the intermediate layer can be carried out, for example, under a molding pressure of 0.5 MPa or more and 25 MPa or less at a molding temperature of −20° C. or more and 70° C. or less relative to the flow beginning temperature of the resin composition. By carrying out the molding under the above conditions, the intermediate layer with a uniform thickness can be formed.

The embodiment for molding the resin composition into the cover is not particularly limited, and examples thereof include an embodiment of injection molding the resin composition directly onto the intermediate layer; and an embodiment of molding the resin composition into hollow shells, covering the intermediate layer with a plurality of the hollow shells, and performing compression molding (preferably an embodiment of molding the resin composition into hollow half shells, covering the intermediate layer with two of the half shells, and performing compression molding). The golf ball body having the cover formed thereon is ejected from the mold, and as necessary, is preferably subjected to surface treatments such as deburring, cleaning and sandblast. Further, if desired, a mark may be formed thereon.

The total number of the dimples formed on the cover is preferably 200 or more and 500 or less. If the total number of the dimples is less than 200, the dimple effect is hardly obtained. On the other hand, if the total number of the dimples exceeds 500, the dimple effect is hardly obtained because the size of the respective dimples is small. The shape (shape in a plan view) of the formed dimples includes, for example, without limitation, a circle; a polygonal shape such as a roughly triangular shape, a roughly quadrangular shape, a roughly pentagonal shape, and a roughly hexagonal shape; and other irregular shape. The shape of the dimples may be employed solely, or two or more of the shapes may be employed in combination.

The paint film preferably has a thickness of, but not particularly limited to, 5 μm or more, more preferably 7 μm or more, and preferably has a thickness of 50 μm or less, more preferably 40 μm or less, and even more preferably 30 μm or less. If the thickness of the paint film is less than 5 μm, the paint film is easy to wear off due to continued use of the golf ball, and if the thickness of the paint film is more than 50 μm, the dimple effect is reduced, and thus the flight performance of the golf ball may deteriorate.

EXAMPLES

Hereinafter, the present invention will be described in detail by way of examples. However, the present invention is not limited to the examples described below, and various changes and modifications can be made without departing from the spirit and scope of the present invention.

[Evaluation Method]

(1) Core Hardness Distribution (Shore C Hardness)

The Shore C hardness measured on the surface of the spherical core (outer layer core), with a type P1 auto loading durometer commercially available from Kobunshi Keiki Co., Ltd., provided with a Shore C type spring hardness tester, was adopted as the surface hardness of the outer layer core. In addition, the core was cut into two hemispheres to obtain a cut plane, and the hardness was measured at the central point of the cut plane and at the point having a predetermined distance from the central point of the cut plane. It is noted that the hardness at four points having the predetermined distance from the central point were measured, and the hardness was determined by averaging the hardness at four points.

(2) Slab Hardness (Shore C Hardness)

Sheets with a thickness of about 2 mm were produced by injection molding the resin composition. These sheets were stored at 23° C. for two weeks. Three or more of these sheets were stacked on one another so as not to be affected by the measuring substrate on which the sheets were placed, and the hardness of the stack was measured with a type P1 auto loading durometer commercially available from Kobunshi Keiki Co., Ltd., provided with a Shore C type spring hardness tester.

(3) Compression Deformation Amount (mm)

The compression deformation amount of the golf ball or the spherical core along the compression direction (shrinking amount of the golf ball or the spherical core along the compression direction), when applying a load from 98 N as an initial load to 1275 N as a final load to the golf ball or the spherical core, was measured.

(4) Spin Rate, Ball Initial Velocity and Flight Distance on Driver Shots

A driver provided with a titanium head (trade name: "XXIO", shaft hardness: S, loft angel: 10.0°, commercially available from Dunlop Sports Co. Limited) was installed on a swing machine commercially available from True Temper Sports, Inc. The golf ball was hit at a head speed of 45 m/sec, and the ball initial velocity (m/s) and the spin rate (rpm) right after hitting the golf ball, and the flight distance (the distance (yd) from the launch point to the stop point) were measured. This measurement was conducted ten times for each golf ball, and the average value thereof was adopted as the measurement value for the golf ball. A sequence of photographs of the hit golf ball were taken for measuring the spin rate right after hitting the golf ball.

(5) Shot feeling

Ten golfers were allowed to hit the golf ball with a driver and to evaluate the shot feeling. The shot feeling was graded as follows, based on the number of the golfers who answered "the shot feeling is soft".

E (excellent): 9 or more
G (good): 6 or more and 8 or less
F (fair): 3 or more and 5 or less
P (poor): 2 or less

[Production of Golf Ball]

(1) Production of Spherical Core

Golf balls No. 1 to 22 and 24 to 27

The materials having the formulations shown in Table 1 were kneaded with a kneading roll to prepare the rubber compositions. The rubber compositions shown in Tables 3-5 were heat-pressed at 170° C. for 25 minutes in upper and lower molds having a hemispherical cavity to produce the inner layer core. Then, the rubber compositions shown in Tables 3-5 were molded into half shells. Two of the half shells were used to cover the inner layer core. The inner layer core and the half shells were heat-pressed together at a temperature ranging from 140° C. to 170° C. for 25 minutes in upper and lower molds having a hemispherical cavity to produce the spherical core. It is noted that the amount of barium sulfate in Table 1 was adjusted such that the density of the inner layer is identical to the density of the outer layer.

Golf Ball No. 23

The materials having the formulations shown in Table 1 were kneaded with a kneading roll to prepare the rubber compositions. The rubber compositions shown in Table 5 were heat-pressed at a temperature ranging from 150° C. to 170° C. for 25 minutes in upper and lower molds having a hemispherical cavity to produce the single-layered cores. It is noted that the amount of barium sulfate in Table 1 was adjusted such that the golf ball has a mass in a range from 45.00 g to 45.92 g.

TABLE 1

| | | Rubber composition No. | | | | | | | | | | |
|---|---|---|---|---|---|---|---|---|---|---|---|---|
| | | 1 | 2 | 3 | 4 | 5 | 6 | 7 | 8 | 9 | 10 | 11 |
| Formulation (parts by mass) | Polybutadiene rubber | 100 | 100 | 100 | 100 | 100 | 100 | 100 | 100 | 100 | 100 | 100 |
| | Magnesium oxide | — | — | — | — | — | — | 34.8 | — | — | — | — |
| | Methacrylic acid | — | — | — | — | — | — | 25.5 | — | — | — | — |
| | Zinc acrylate | 17.5 | 35 | 29 | 37.5 | 22.5 | 30 | — | 26 | 23.5 | 19 | 10.5 |
| | Zinc oxide | 12 | 5 | 5 | 5 | 5 | 5 | — | 12 | 5 | 5 | 12 |
| | Barium sulfate | *) | *) | *) | *) | *) | *) | — | *) | *) | *) | *) |
| | Dicumyl peroxide | 0.9 | 0.7 | 0.7 | 0.7 | 0.7 | 0.9 | 0.9 | 0.9 | 0.7 | 0.7 | 0.9 |
| | PBDS | — | — | — | — | — | 0.3 | — | — | — | — | — |
| | DPDS | — | 0.5 | 0.5 | 0.5 | 0.5 | — | — | — | 0.5 | 0.5 | — |
| | 2-Thionaphtol | 0.1 | — | — | — | — | — | — | 0.1 | — | — | 0.1 |

TABLE 1-continued

| | Rubber composition No. | | | | | | | | | | |
|---|---|---|---|---|---|---|---|---|---|---|---|
| | 1 | 2 | 3 | 4 | 5 | 6 | 7 | 8 | 9 | 10 | 11 |
| Benzoic acid | 2 | — | — | — | — | — | — | 2 | — | — | 2 |
| Antioxidant | — | 0.1 | — | 0.1 | 0.1 | — | — | — | 0.1 | 0.1 | — |

*) Appropriate amount
Polybutadiene rubber: "BR730 (cis-bond content: 96 mass %)" commercially available from JSR Corporation
Magnesium oxide: "MAGSARAT (registered trademark) 150ST" commercially available from Kyowa Chemical Industry Co., Ltd.
Methacrylic acid: commercially available from Mitsubishi Rayon Co., Ltd.
Zinc acrylate: "Sanceler (registered trademark) SR" commercially available from Sanshin Chemical Industry Co., Ltd.
Zinc oxide: "Ginrei (registered trademark) R" commercially available from Toho Zinc Co., Ltd.
Barium sulfate: "Barium Sulfate BD" commercially available from Sakai Chemical Industry Co., Ltd.
Dicumyl peroxide: "Percumyl (registered trademark) D" commercially available from NOF Corporation
PBDS (bis(pentabromophenyl) persulfide): commercially available from Kawaguchi Chemical Industry Co., Ltd.
DPDS (diphenyldisulfide): commercially available from Sumitomo Seika Chemicals Co., Ltd.
2-Thionaphtol: commercially available from Zhejiang shou & Fu Chemical Co., Ltd.
Benzoic acid: commercially available from Emerald Kalama Chemical Co., Ltd.
Antioxidant (dibutylhydroxytoluene): "H-BHT" commercially available from Honshu Chemical Industry Co. Ltd.

(2) Preparation of Resin Composition

The materials having the formulations shown in Table 2 were mixed with a twin-screw kneading extruder to prepare the resin composition in a pellet form. The extruding conditions were a screw diameter of 45 mm, a screw rotational speed of 200 rpm, and a screw L/D=35, and the mixture was heated to 160° C. to 230° C. at the die position of the extruder.

TABLE 2

| | | Resin composition No. | | | | |
|---|---|---|---|---|---|---|
| | | a | b | e | f | g |
| Formulation (parts by mass) | Himilan 1605 | — | 50 | — | — | — |
| | Himilan AM7329 | 55 | 50 | 41.5 | 26 | 45 |
| | Himilan AM7337 | 5 | — | 34.5 | 26 | 25 |
| | Himilan 1555 | 10 | — | — | — | — |
| | Rabalon 132210 | — | — | 14 | 48 | 30 |
| | Nucrel N1050H | 30 | — | 10 | — | — |
| | Titanium dioxide | 3 | 4 | 4 | 6 | 6 |
| | Barium sulfate | *) | *) | *) | *) | *) |
| | JF-90 | 0.2 | — | — | — | — |
| Slab hardness (Shore C) | | 92 | 96 | 86 | 65 | 81 |

*) Appropriate amount
The materials used in Table 2 are as follows.
Himilan (registered trademark) 1605: sodium ion-neutralized ethylene-methacrylic acid copolymer ionomer resin commercially available from Du Pont-Mitsui Polychemicals Co., Ltd.
Himilan AM7329: zinc ion-neutralized ethylene-methacrylic acid copolymer ionomer resin commercially available from Du Pont-Mitsui Polychemicals Co., Ltd.
Himilan AM7337: sodium ion-neutralized ethylene-methacrylic acid copolymer ionomer resin commercially available from Du Pont-Mitsui Polychemicals Co., Ltd.
Himilan 1555: sodium ion-neutralized ethylene-methacrylic acid copolymer ionomer resin commercially available from Du Pont-Mitsui Polychemicals Co., Ltd.

TABLE 2-continued

| | Resin composition No. | | | | |
|---|---|---|---|---|---|
| | a | b | e | f | g |

Rabalon (registered trademark) T3221C: thermoplastic styrene elastomer commercially available from Mitsubishi Chemical Corporation
Nucrel (registered trademark) N1050H: ethylene-methacrylic acid copolymer commercially available from Du Pont-Mitsui Polychemicals Co., Ltd.
Barium sulfate: "Barium Sulfate BD" commercially available from Sakai Chemical Industry Co., Ltd.
JF-90: light stabilizer commercially available from Johoku Chemical Co., Ltd.

(3) Production of Intermediate Layer

Golf Balls No. 2 to 27

The resin compositions shown in Tables 3 to 5 were injection molded on the core obtained above to form the intermediate layer. It is noted that the amount of barium sulfate in Table 2 was adjusted such that the slab hardness became the desired value.

(4) Production of Cover

Golf Balls No. 1 to 27

The resin compositions shown in Tables 3 to 5 were injection molded on the intermediate layer-covered spherical body obtained above to form the cover layer. It is noted that the amount of barium sulfate in Table 2 was adjusted such that the slab hardness became the desired value. A plurality of dimples were formed on the cover.

The surfaces of the obtained golf ball bodies were treated with sandblast and marked. Then, the clear paint was applied on the surfaces of the golf ball bodies and dried in an oven to obtain the golf balls. The evaluation results of the obtained golf balls are shown in Tables 3 to 5.

TABLE 3

| | | | Golf ball No. | | | | | | | | |
|---|---|---|---|---|---|---|---|---|---|---|---|
| | | | 1 | 2 | 3 | 4 | 5 | 6 | 7 | 8 | 9 |
| Spherical core | Inner layer | Rubber composition No. | 1 | 1 | 1 | 7 | 1 | 1 | 1 | 1 | 1 |
| | | Radius X (mm) | 12.0 | 12.0 | 12.0 | 7.5 | 10.0 | 12.0 | 12.0 | 12.0 | 12.0 |
| | Outer layer | Rubber composition No. | 2 | 2 | 2 | 2 | 2 | 2 | 2 | 2 | 2 |
| | | Thickness Y (mm) | 7.3 | 8.1 | 7.6 | 11.8 | 9.3 | 7.3 | 7.3 | 7.3 | 7.3 |
| | Hardness (Shore C) | Ho | 58 | 58 | 58 | 57 | 58 | 58 | 58 | 58 | 58 |
| | | $H_{X-1}$ | 69 | 69 | 69 | 60 | 67 | 69 | 69 | 69 | 69 |
| | | $H_{X+1}$ | 80 | 80 | 80 | 80 | 80 | 80 | 80 | 80 | 80 |
| | | $H_{X+Y}$ | 80 | 80 | 80 | 80 | 80 | 80 | 80 | 80 | 80 |
| | | $H_{X-1}$ − Ho | 11 | 11 | 11 | 3 | 9 | 11 | 11 | 11 | 11 |
| | | $H_{X+1}$ − $H_{X-1}$ | 11 | 11 | 11 | 20 | 13 | 11 | 11 | 11 | 11 |
| | | $H_{X+Y}$ − $H_{X+1}$ | 0 | 0 | 0 | 0 | 0 | 0 | 0 | 0 | 0 |
| | | $H_{X+Y}$ − Ho | 22 | 22 | 22 | 23 | 22 | 22 | 22 | 22 | 22 |

TABLE 3-continued

| | | | Golf ball No. | | | | | | | | |
|---|---|---|---|---|---|---|---|---|---|---|---|
| | | | 1 | 2 | 3 | 4 | 5 | 6 | 7 | 8 | 9 |
| | Angel (°) | α | 45.0 | 45.0 | 45.0 | 24.8 | 45.0 | 45.0 | 45.0 | 45.0 | 45.0 |
| | | β | 0.0 | 0.0 | 0.0 | 0.0 | 0.0 | 0.0 | 0.0 | 0.0 | 0.0 |
| | | α − β | 45.0 | 45.0 | 45.0 | 24.8 | 45.0 | 45.0 | 45.0 | 45.0 | 45.0 |
| | Diameter (mm) | | 38.5 | 40.1 | 39.1 | 38.5 | 38.5 | 38.5 | 38.5 | 38.5 | 38.5 |
| | Ratio (Y/X) | | 0.6 | 0.7 | 0.6 | 1.6 | 0.9 | 0.6 | 0.6 | 0.6 | 0.6 |
| | Compression deformation amount (mm) | | 3.4 | 3.4 | 3.4 | 3.6 | 3.4 | 3.4 | 3.4 | 3.4 | 3.4 |
| Intermediate layer | Resin composition No. | | — | f | f | f | f | f | f | f | f |
| | Thickness Tm (mm) | | — | 0.6 | 0.8 | 1.0 | 1.0 | 1.0 | 1.0 | 1.0 | 1.0 |
| | Hardness Hm (Shore C) | | — | 65 | 65 | 65 | 65 | 65 | 65 | 65 | 65 |
| Cover | Resin composition No. | | a | a | a | a | a | g | e | a | b |
| | Thickness Tc (mm) | | 2.1 | 0.7 | 1.0 | 1.1 | 1.1 | 1.1 | 1.1 | 1.1 | 1.1 |
| | Hardness Hc (Shore C) | | 92 | 92 | 92 | 92 | 92 | 81 | 86 | 92 | 96 |
| Total thickness (Tc + Tm) | | | — | 1.3 | 1.8 | 2.1 | 2.1 | 2.1 | 2.1 | 2.1 | 2.1 |
| Ratio (Tc/Tm) | | | — | 1.2 | 1.3 | 1.1 | 1.1 | 1.1 | 1.1 | 1.1 | 1.1 |
| Hardness difference (Hm − $H_{X+Y}$) | | | — | −15 | −15 | −15 | −15 | −15 | −15 | −15 | −15 |
| Hardness difference (Hc − $H_{X+Y}$) | | | 12 | 12 | 12 | 12 | 12 | 1 | 6 | 12 | 16 |
| Hardness difference (Hc − Hm) | | | — | 27 | 27 | 27 | 27 | 16 | 21 | 27 | 31 |
| Evaluation for golf ball | Compression deformation amount (mm) | | 2.90 | 3.01 | 2.98 | 3.17 | 2.97 | 3.00 | 2.99 | 2.97 | 2.96 |
| | Ball initial velocity (m/s) | | 65.0 | 64.9 | 65.0 | 65.5 | 65.4 | 64.9 | 64.9 | 65.0 | 65.0 |
| | Spin rate (rpm) | | 2,850 | 3,010 | 2,820 | 2,950 | 2,850 | 2,935 | 2,915 | 2,900 | 2,860 |
| | Flight distance (yd) | | 250.1 | 250.8 | 250.5 | 251.3 | 251.8 | 248.8 | 249.1 | 249.3 | 250.0 |
| | Shot feeling | | P | E | E | G | G | E | E | E | G |

TABLE 4

| | | | Golf ball No. | | | | | | | | |
|---|---|---|---|---|---|---|---|---|---|---|---|
| | | | 10 | 11 | 12 | 13 | 14 | 15 | 16 | 17 | 18 |
| Spherical core | Inner layer | Rubber composition No. | 1 | 1 | 1 | 1 | 1 | 1 | 1 | 1 | 5 |
| | | Radius X (mm) | 12.0 | 12.0 | 12.0 | 12.0 | 12.0 | 12.0 | 12.0 | 12.0 | 12.0 |
| | Outer layer | Rubber composition No. | 2 | 2 | 2 | 2 | 2 | 2 | 3 | 4 | 2 |
| | | Thickness Y (mm) | 7.3 | 7.3 | 7.3 | 7.3 | 7.3 | 7.3 | 7.3 | 7.3 | 7.3 |
| | Hardness (Shore C) | Ho | 58 | 58 | 58 | 58 | 58 | 58 | 58 | 58 | 65 |
| | | $H_{X-1}$ | 69 | 69 | 69 | 69 | 69 | 69 | 69 | 69 | 65 |
| | | $H_{X+1}$ | 80 | 80 | 80 | 80 | 80 | 80 | 79 | 81 | 80 |
| | | $H_{X+Y}$ | 80 | 80 | 80 | 80 | 80 | 80 | 81 | 79 | 80 |
| | | $H_{X-1}$ − Ho | 11 | 11 | 11 | 11 | 11 | 11 | 11 | 11 | 0 |
| | | $H_{X+1}$ − $H_{X-1}$ | 11 | 11 | 11 | 11 | 11 | 11 | 10 | 12 | 15 |
| | | $H_{X+Y}$ − $H_{X+1}$ | 0 | 0 | 0 | 0 | 0 | 0 | 2 | −2 | 0 |
| | | $H_{X+Y}$ − Ho | 22 | 22 | 22 | 22 | 22 | 22 | 23 | 21 | 15 |
| | Angel (°) | α | 45.0 | 45.0 | 45.0 | 45.0 | 45.0 | 45.0 | 45.0 | 45.0 | 0.0 |
| | | β | 0.0 | 0.0 | 0.0 | 0.0 | 0.0 | 0.0 | 17.7 | −17.7 | 0.0 |
| | | α − β | 45.0 | 45.0 | 45.0 | 45.0 | 45.0 | 45.0 | 27.3 | 62.7 | 0.0 |
| | Diameter (mm) | | 38.5 | 38.5 | 38.5 | 38.5 | 38.5 | 38.5 | 38.5 | 38.5 | 38.5 |
| | Ratio (Y/X) | | 0.6 | 0.6 | 0.6 | 0.6 | 0.6 | 0.6 | 0.6 | 0.6 | 0.6 |
| | Compression deformation amount (mm) | | 3.4 | 3.4 | 3.4 | 3.4 | 3.4 | 3.4 | 3.4 | 3.4 | 3.6 |
| Intermediate layer | Resin composition No. | | g | g | g | e | e | a | f | f | f |
| | Thickness Tm (mm) | | 1.0 | 1.0 | 1.0 | 1.0 | 1.0 | 1.0 | 1.0 | 1.0 | 1.0 |
| | Hardness Hm (Shore C) | | 81 | 81 | 81 | 86 | 86 | 92 | 65 | 65 | 65 |
| Cover | Resin composition No. | | e | a | b | a | b | b | a | a | a |
| | Thickness Tc (mm) | | 1.1 | 1.1 | 1.1 | 1.1 | 1.1 | 1.1 | 1.1 | 1.1 | 1.1 |
| | Hardness Hc (Shore C) | | 86 | 92 | 96 | 92 | 96 | 96 | 92 | 92 | 92 |
| | Total thickness (Tc + Tm) | | 2.1 | 2.1 | 2.1 | 2.1 | 2.1 | 2.1 | 2.1 | 2.1 | 2.1 |
| | Ratio (Tc/Tm) | | 1.1 | 1.1 | 1.1 | 1.1 | 1.1 | 1.1 | 1.1 | 1.1 | 1.1 |
| | Hardness difference (Hm − $H_{X+Y}$) | | 1 | 1 | 1 | 6 | 6 | 12 | −16 | −14 | −15 |
| | Hardness difference (Hc − $H_{X+Y}$) | | 6 | 12 | 16 | 12 | 16 | 16 | 11 | 13 | 12 |
| | Hardness difference (Hc − Hm) | | 5 | 11 | 15 | 6 | 10 | 4 | 27 | 27 | 27 |
| Evaluation for golf ball | Compression deformation amount (mm) | | 2.95 | 2.93 | 2.92 | 2.92 | 2.90 | 2.89 | 2.97 | 2.97 | 3.17 |
| | Ball initial velocity (m/s) | | 65.0 | 65.0 | 65.1 | 65.2 | 65.2 | 65.3 | 64.9 | 64.9 | 65.2 |
| | Spin rate (rpm) | | 2,845 | 2,825 | 2,760 | 2,750 | 2,700 | 2,800 | 2,850 | 2,950 | 3,050 |
| | Flight distance (yd) | | 250.2 | 250.5 | 251.5 | 251.8 | 252.6 | 251.8 | 251.8 | 251.1 | 251.3 |
| | Shot feeling | | G | G | F | P | P | P | E | G | F |

TABLE 5

| | | | Golf ball No. | | | | | | | | |
|---|---|---|---|---|---|---|---|---|---|---|---|
| | | | 19 | 20 | 21 | 22 | 23 | 24 | 25 | 26 | 27 |
| Spherical core | Inner layer | Rubber composition No. | 1 | 9 | 11 | 1 | 6 | 1 | 1 | 1 | 1 |
| | | Radius X (mm) | 12.0 | 12.0 | 12.0 | 12.0 | 19.3 | 13.5 | 15.0 | 12.0 | 12.0 |
| | Outer layer | Rubber composition No. | 8 | 2 | 10 | 10 | — | 2 | 2 | 2 | 2 |
| | | Thickness Y (mm) | 7.3 | 7.3 | 7.3 | 7.3 | — | 5.8 | 4.3 | 6.9 | 6.2 |
| | Hardness (Shore C) | Ho | 58 | 67 | 47 | 58 | 49 | 58 | 58 | 58 | 58 |
| | | $H_{X-1}$ | 69 | 65 | 58 | 69 | — | 69 | 69 | 69 | 69 |
| | | $H_{X+1}$ | 71 | 80 | 63 | 63 | — | 80 | 80 | 80 | 80 |
| | | $H_{X+Y}$ | 80 | 80 | 63 | 63 | 75 | 80 | 80 | 80 | 80 |
| | | $H_{X-1}$ − Ho | 11 | −2 | 11 | 11 | — | 11 | 11 | 11 | 11 |
| | | $H_{X+1}$ − $H_{X-1}$ | 2 | 15 | 5 | −6 | — | 11 | 11 | 11 | 11 |
| | | $H_{X+Y}$ − $H_{X+1}$ | 9 | 0 | 0 | 0 | — | 0 | 0 | 0 | 0 |
| | | $H_{X+Y}$ − Ho | 22 | 13 | 16 | 5 | 26 | 22 | 22 | 22 | 22 |
| | Angel (°) | α | 45.0 | −10.3 | 45.0 | 45.0 | — | 41.3 | 38.2 | 45.0 | 45.0 |
| | | β | 55.2 | 0.0 | 0.0 | 0.0 | — | 0.0 | 0.0 | 0.0 | 0.0 |
| | | α − β | −10.2 | −10.3 | 45.0 | 45.0 | — | 41.3 | 38.2 | 45.0 | 45.0 |
| | Diameter (mm) | | 38.5 | 38.5 | 38.5 | 38.5 | 38.5 | 38.5 | 38.5 | 37.7 | 36.3 |
| | Ratio (Y/X) | | 0.6 | 0.6 | 0.6 | 0.6 | 0.0 | 0.4 | 0.3 | 0.6 | 0.5 |
| | Compression deformation amount (mm) | | 3.4 | 3.4 | 3.8 | 3.8 | 3.6 | 3.4 | 3.4 | 3.4 | 3.4 |
| Intermediate layer | Resin composition No. | | f | f | f | f | f | f | f | f | f |
| | Thickness Tm (mm) | | 1.0 | 1.0 | 1.0 | 1.0 | 1.0 | 1.0 | 1.0 | 1.0 | 1.6 |
| | Hardness Hm (Shore C) | | 65 | 65 | 65 | 65 | 65 | 65 | 65 | 65 | 65 |
| Cover | Resin composition No. | | a | a | a | a | a | a | a | a | a |
| | Thickness Tc (mm) | | 1.1 | 1.1 | 1.1 | 1.1 | 1.1 | 1.1 | 1.1 | 1.5 | 1.6 |
| | Hardness Hc (Shore C) | | 92 | 92 | 92 | 92 | 92 | 92 | 92 | 92 | 92 |
| Total thickness (Tc + Tm) | | | 2.1 | 2.1 | 2.1 | 2.1 | 2.1 | 2.1 | 2.1 | 2.5 | 3.2 |
| Ratio (Tc/Tm) | | | 1.1 | 1.1 | 1.1 | 1.1 | 1.1 | 1.1 | 1.1 | 1.5 | 1.0 |
| Hardness difference (Hm − $H_{X+Y}$) | | | −15 | −15 | 2 | 2 | −10 | −15 | −15 | −15 | −15 |
| Hardness difference (Hc − $H_{X+Y}$) | | | 12 | 12 | 29 | 29 | 17 | 12 | 12 | 12 | 12 |
| Hardness difference (Hc − Hm) | | | 27 | 27 | 27 | 27 | 27 | 27 | 27 | 27 | 27 |
| Evaluation for golf ball | Compression deformation amount (mm) | | 2.97 | 2.97 | 3.37 | 3.37 | 3.17 | 2.97 | 2.97 | 2.94 | 2.91 |
| | Ball initial velocity (m/s) | | 64.3 | 64.8 | 64.2 | 64.3 | 64.1 | 64.8 | 64.4 | 64.9 | 64.8 |
| | Spin rate (rpm) | | 2,900 | 3,150 | 2,950 | 3,050 | 2,850 | 2,800 | 2,700 | 3,000 | 3,150 |
| | Flight distance (yd) | | 248.3 | 248.6 | 247.6 | 247.1 | 248.1 | 251.8 | 250.8 | 250.3 | 248.6 |
| | Shot feeling | | G | F | G | F | F | E | E | G | P |

Golf balls No. 4, 5, 8 and 16 to 25 having the same formulation and thickness in the intermediate layer and in the cover, are compared. Golf ball No. 19 is the case where the difference (α−β) between the angle α of the hardness gradient of the inner layer and the angle β of the hardness gradient of the outer layer is less than 0°. Golf ball No. 20 is the case where the angle α of the hardness gradient of the inner layer is less than 0°. Golf ball No. 21 is the case where the surface hardness ($H_{X+Y}$) is 65 or less in Shore C hardness. Golf ball No. 22 is the case where the difference ($H_{X+1}$-$H_{X-1}$) is less than 0 in Shore C hardness. Golf ball No. 23 is the case where the spherical core is single-layered. These Golf balls No. 19 to 23 travel a short distance on driver shots.

In addition, Golf balls No. 6 to 15 comprising the same spherical core are compared. Golf balls No. 6 to 12 are the cases where the difference (Hm−$H_{x+y}$) is 1 or less. Golf balls No. 13 to 15 are the cases where the difference (Hm−$H_{x+y}$) exceeds 1. By comparing these golf balls, it is found that Golf balls No. 6 to 12 having the difference (Hm−$H_{x+y}$) of 1 or less exhibit a better shot feeling.

This application is based on Japanese Patent Application No. 2015-090787 filed on Apr. 27, 2015, the contents of which are hereby incorporated by reference.

The invention claimed is:

1. A golf ball comprising a spherical core, an intermediate layer positioned outside the spherical core, and a cover positioned outside the intermediate layer, wherein the spherical core consists of an inner layer and an outer layer, and the inner layer and the outer layer of the spherical core are each independently formed from a rubber composition, a difference ($H_{x+1}$−$H_{x-1}$) between a hardness ($H_{x+1}$) at a point outwardly away in a radial direction from a boundary between the inner layer, and the outer layer of the spherical core by 1 mm and a hardness ($H_{x-1}$) at a point inwardly away in the radial direction from the boundary between the inner layer and the outer layer of the spherical core by 1 mm, is 0 or more in Shore C hardness, a surface hardness ($H_{x+y}$) of the spherical core is more than 65 in Shore C hardness, an angle α of a hardness gradient of the inner layer calculated by a formula (1) ranges from 0° to 45°, a difference (α−β) between the angle α and an angle β of a hardness gradient of the outer layer calculated by a formula (2) is 0° or more, a total thickness of a thickness (Tm) of the intermediate layer and a thickness (Tc) of the cover is 3 mm or less, and a material hardness (Hc) of the cover is highest among a center hardness (Ho) of the spherical core, the hardness ($H_{x+1}$), the hardness ($H_{x-1}$), the hardness ($H_{x+y}$), a material hardness (Hm) of the intermediate layer, and the material hardness (Hc) of the cover, $$\alpha=(180/\pi)\times a\tan[\{H_{x-1}-Ho\}/(X-1)] \quad (1)$$

$$\beta=(180/\pi)\times a\tan[\{H_{X+Y}-H_{x+1}\}/(Y-1)] \quad (2)$$

where

X represents a radius (mm) of the inner layer,

Y represents a thickness (mm) of the outer layer,

Ho represents a center hardness (Shore C) of the spherical core, $H_{X-1}$ represents the hardness (Shore C) at the point inwardly away in the radial direction from the boundary between the inner layer and the outer layer of the spherical core by 1 mm, $H_{X+1}$ represents the hardness (Shore C) at the point outwardly away in the radial direction from the boundary between the inner layer and the outer layer of the spherical core by 1 mm, and $H_{X+Y}$ represents the surface hardness (Shore C) of the spherical core.

2. The golf ball according to claim 1, wherein a difference ($Hm-H_{x+y}$) between a hardness (Hm) of the intermediate layer and the surface hardness ($H_{X+Y}$) of the spherical core is 1 or less in Shore C hardness.

3. The golf ball according to claim 1, wherein the center hardness (Ho) of the spherical core is less than 65 in Shore C hardness.

4. The golf ball according to claim 1, wherein the angle β ranges from −20° to +20°.

5. The golf ball according to claim 1, wherein a hardness (Hc) of the cover is 75 or more in Shore C hardness, and a hardness (Hm) of the intermediate layer ranges from 60 to 85 in Shore C hardness.

6. The golf ball according to claim 1, wherein a difference (Hc−Hm) between a hardness (Hc) of the cover and a hardness (Hm) of the intermediate layer ranges from 5 to 31 in Shore C hardness.

7. The golf ball according to claim 1, wherein a difference ($Hc-H_{X+Y}$) between a hardness (Hc) of the cover and the surface hardness ($H_{X+Y}$) of the spherical core ranges from 1 to 16 in Shore C hardness.

8. The golf ball according to claim 1, wherein a ratio (Tc/Tm) of the thickness (Tc) of the cover to the thickness (Tm) of the intermediate layer ranges from 1.00 to 5.00.

9. The golf ball according to claim 1, wherein the thickness (Tc) of the cover ranges from 0.5 mm to 2.5 mm, and the thickness (Tm) of the intermediate layer ranges from 0.5 mm to 2.0 mm.

10. The golf ball according to claim 1, wherein the difference (α−β) between the angle α and the angle β is larger than 10°.

11. The golf ball according to claim 1, wherein the hardness ($H_{X-1}$) ranges from 63 to 82 in Shore C hardness, and the hardness ($H_{X+1}$) ranges from 70 to 90 in Shore C hardness.

12. The golf ball according to claim 1, wherein the difference (α−β) between the angle α and the angle β ranges from 24.8° to 85°.

13. The golf ball according to claim 1, wherein a difference ($H_{x-1}-Ho$) between the hardness ($H_{X-1}$) and the center hardness (Ho) of the spherical core ranges from 4 to 27 in Shore C hardness.

14. The golf ball according to claim 1, wherein a difference ($H_{X+Y}-H_{x+1}$) between the surface hardness ($H_{X+Y}$) of the spherical core and the hardness ($H_{X+1}$) ranges from −7 to 10 in Shore C hardness.

15. The golf ball according to claim 1, wherein a difference ($H_{X+Y}-Ho$) between the surface hardness ($H_{x+y}$) and the center hardness (Ho) of the spherical core ranges from 14 to 35 in Shore C hardness.

16. The golf ball according to claim 1, wherein the radius (X) of the inner layer ranges from 7 mm to 16 mm, and the thickness (Y) of the outer layer ranges from 3 mm to 12 mm.

17. The golf ball according to claim 1, wherein the angle α is 38.2° or larger.

18. The golf ball according to claim 1, wherein a ratio (Y/X) of the thickness (Y) of the outer layer to the radius (X) of the inner layer ranges from 0.2 to 2.0.

19. A golf ball comprising a spherical core, an intermediate layer positioned outside the spherical core, and a cover positioned outside the intermediate layer, wherein the spherical core includes an inner layer and an outer layer, a difference ($H_{X+1}-H_{X-1}$) between a hardness ($H_{X+1}$) at a point outwardly away in a radial direction from a boundary between the inner layer and the outer layer of the spherical core by 1 mm and a hardness ($H_{X-1}$) at a point inwardly away in the radial direction from the boundary between the inner layer and the outer layer of the spherical core by 1 mm ranges from 8 to 20 in Shore C hardness, a surface hardness ($H_{X+Y}$) of the spherical core is more than 65 and 86 or less in Shore C hardness, an angle α of a hardness gradient of the inner layer calculated by a formula (1) ranges from 0° to 45°, a difference (α−β)between the angle α and an angle β of a hardness gradient of the outer layer calculated by a formula (2) is 0° or more, a total thickness of a thickness (Tm) of the intermediate layer and a thickness (Tc) of the cover is 3 mm or less, a ratio (Tc/Tm) of the thickness (Tc) of the cover to the thickness (Tm) of the intermediate layer ranges from 1.10 to 5.00, a hardness (Hm) of the intermediate layer ranges from 64 to 85 in Shore C hardness, and a material hardness (Hc) of the cover is highest among a center hardness (Ho) of the spherical core, the hardness ($H_{X+1}$), the hardness ($H_{X-1}$), the hardness ($H_{X+Y}$), a material hardness (Hm) of the intermediate layer, and the material hardness (Hc) of the cover, $$\alpha=(180/\pi)\times a\tan[\{H_{x-}-Ho\}/(X-1)] \quad (1)$$

$$\beta=(180/\pi)\times a\tan[\{H_{X+Y}-H_{x+1}\}/(Y-1)] \quad (2)$$

where

X represents a radius (mm) of the inner layer,

Y represents a thickness (mm) of the outer layer,

Ho represents a center hardness (Shore C) of the spherical core, $H_{X-1}$ represents the hardness (Shore C) at the point inwardly away in the radial direction from the boundary between the inner layer and the outer layer of the spherical core by 1 mm, $H_{X+1}$ represents the hardness (Shore C) at the point outwardly away in the radial direction from the boundary between the inner layer and the outer layer of the spherical core by 1 mm, and $H_{X+Y}$ represents the surface hardness (Shore C) of the spherical core.

* * * * *